US010571158B2

(12) United States Patent
Bonne et al.

(10) Patent No.: US 10,571,158 B2
(45) Date of Patent: Feb. 25, 2020

(54) REFRIGERATION METHOD, AND CORRESPONDING COLD BOX AND CRYOGENIC EQUIPMENT

(71) Applicant: L'Air Liquide, Societe Anonyme pour l'Etude et l'Exploitation des Procedes Georges Claude, Paris (FR)

(72) Inventors: Frederic Bonne, Paris (FR); Mustapha Tebbani, Massy (FR); Alain Briglia, Hangzhou (CN); Oriane De La Forterie, Paris (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 862 days.

(21) Appl. No.: 15/102,029

(22) PCT Filed: Nov. 6, 2014

(86) PCT No.: PCT/FR2014/052837

§ 371 (c)(1),
(2) Date: Jun. 6, 2016

(87) PCT Pub. No.: WO2015/082788

PCT Pub. Date: Jun. 11, 2015

(65) Prior Publication Data

US 2016/0341452 A1 Nov. 24, 2016

(30) Foreign Application Priority Data

Dec. 6, 2013 (FR) ..... 13 62240

(51) Int. Cl.
*F25B 9/00* (2006.01)
*F25B 9/14* (2006.01)
*F25B 9/10* (2006.01)

(52) U.S. Cl.
CPC ..... *F25B 9/14* (2013.01)

(58) Field of Classification Search
CPC .. F25J 1/00; F25J 1/0005; F25J 1/0007; F25J 1/001; F25J 1/0047; F25J 1/0055;
(Continued)

(56) References Cited

U.S. PATENT DOCUMENTS 4,346,563 A * 8/1982 Hood ..... F25B 9/00 62/117
4,606,744 A * 8/1986 Kundig ..... F25J 1/0007 62/608

(Continued)

FOREIGN PATENT DOCUMENTS

FR 2 919 713 2/2009
FR 2 919 716 2/2009

OTHER PUBLICATIONS

International Search Report and Written Opinion for PCT/FR2014/052837, dated Jan. 22, 2015.

(Continued)

*Primary Examiner* — Frantz F Jules
*Assistant Examiner* — Erik Mendoza-Wilkenfel
(74) *Attorney, Agent, or Firm* — Justin K. Murray

(57) ABSTRACT

Embodiments of the present invention relate to a refrigeration method, during which a user is supplied with frigories by means of a working gas, such as helium, that is cooled by having the same flow into a cold box that comprises, in series, at least one first aluminum heat exchanger having brazed plates and flanges, one second heat exchanger having welded plates, and one third aluminum heat exchanger having brazed plates and flanges in such a way that the flow of said working gas is at least partially caused to pass, consecutively, through the first exchanger, then through the second exchanger, and finally through the third exchanger before said working gas flow is directed to the user in order to supply the user with frigories.

15 Claims, 1 Drawing Sheet

(58) Field of Classification Search
CPC ... F25J 1/0057; F25B 5/02; F25B 5/04; F25B 2500/07; F25B 2500/26; F25B 2600/2501; F25B 19/005; F25B 9/00; F25B 9/02; F25B 9/06; F25B 9/10; F25B 9/12; F17C 2227/0309; F17C 2227/0374; F17C 2227/0395
See application file for complete search history.

(56) References Cited

U.S. PATENT DOCUMENTS

| | | | | |
|---|---|---|---|---|
| 2011/0192194 | A1* | 8/2011 | Howard | F25J 3/04084 62/644 |
| 2012/0036890 | A1* | 2/2012 | Kimble | F25J 3/0209 62/620 |
| 2014/0144165 | A1* | 5/2014 | Flynn | F25B 9/00 62/115 |

OTHER PUBLICATIONS

French Search Report and Written Opinion for FR 1 362 240, dated Apr. 7, 2014.

* cited by examiner

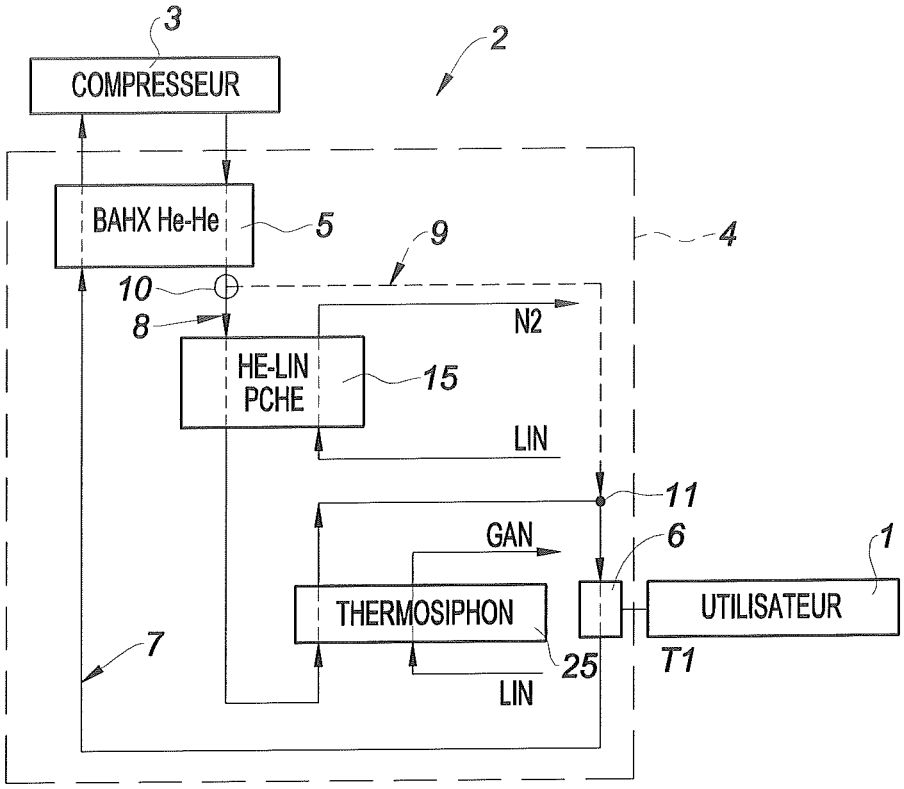
3
COMPRESSEUR
2
BAHX He-He
5
9
4
10
8
N2
HE-LIN
PCHE
15
LIN
11
GAN
6
1
THERMOSIPHON
UTILISATEUR
7
25
T1
LIN

REFRIGERATION METHOD, AND CORRESPONDING COLD BOX AND CRYOGENIC EQUIPMENT

CROSS REFERENCE TO RELATED APPLICATIONS

This application is a § 371 of International PCT Application PCT/FR2014/052837, filed Nov. 6, 2014, which claims the benefit of FR1362240, filed Dec. 6, 2013, both of which are herein incorporated by reference in their entireties.

TECHNICAL FIELD OF THE INVENTION

The present invention relates to a refrigeration and/or liquefaction device and to a corresponding method.

It relates more particularly to a refrigeration method using a working gas such as pure helium or a gaseous mixture containing helium.

BACKGROUND OF THE INVENTION

It is known practice to supply an industrial user with frigories using a working gas circulating in closed circuit or even in open circuit and subjected to a cooling process which generally relies upon a cycle comprising a compression followed by expansions and/or passes through heat exchangers.

In this regard, it is known practice to cause the working gas, after compression, to circulate through a cold box which may notably comprise expansion turbines and/or a plurality of heat exchangers.

However, one of the difficulties associated with the design and operation of such cryogenic installations stems from the need to meet contradictory requirements dependent on whether the refrigeration method is in a transient cooling state or a steady state (or "normal operation") of maintaining a very low temperature.

Specifically, in the steady state, namely when the cryogenic installation is used only to sustain the supply of frigories to the user in order to keep and stabilize said user at a predetermined low operating temperature (for example of the order of 80 K), it is necessary to use very high-performance exchangers, typically brazed (wavy) plate and fin aluminum exchangers ("brazed aluminum heat exchangers") which limit the pressure drops and optimize thermal efficiency.

Such aluminum exchangers do, however, suffer from certain limitations, notably due to the fact that they are mechanically unable to withstand the stresses resulting from a steep thermal gradient between the fluids passing through them, particularly when said fluids circulate countercurrentwise.

Now, significant temperature gradients occur precisely during the transient state, and notably during cooling, namely when the user needs to be brought down from a relatively high starting temperature (typically above 150 K and generally greater than or equal to 300 K) to a relatively low operating temperature (for example of the order of 80 K).

Of course, brazed aluminum exchangers need to be protected during this transient state, which may sometimes extend over a lengthy period and, for example, be as much as several tens of days in the case of a cryogenic installation used to cool superconductor magnets.

Within known cryogenic installations, it has therefore been envisaged, in order to reconcile the aforementioned requirements, for the equipment items to be duplicated and notably for one or more auxiliary cooling systems using volumes (baths) of liquid nitrogen to be added to the inlet of the cold box and for a complex switchover circuit to be provided that allows the stream of working gas to be directed selectively through said auxiliary systems, for the purpose of modifying the configuration of the cryogenic installation on a case-by-case basis according to the operating regime.

Despite such precautions, known cryogenic installations may exhibit uneven performance between the transient state and the steady state, being less well suited to one operating regime than to the other.

Furthermore, said cryogenic installations are very bulky and complex in structure and are expensive to install and to maintain.

SUMMARY OF THE INVENTION

The objects assigned to the invention are therefore aimed at overcoming the aforementioned drawbacks and at proposing a new, effective and multifunctional refrigeration method that makes it possible, whatever the operating regime, and by means of a cryogenic installation that is simple and compact, to achieve high-performance and compliant cooling of said cryogenic installation.

The objects assigned to the invention are achieved by means of a refrigeration method during which a user at a temperature referred to as the "user temperature" is supplied with frigories by means of a working gas, such as helium, which is cooled in a refrigeration circuit which comprises at least one compression station, in which said working gas is compressed, then at least one cold box in which the working gas is cooled by passing it through a plurality of heat exchangers, said method comprising a cooling step (a) during which, during a cooling first phase (a1), the frigories supplied by the cooled working gas are used to lower the user temperature when said user temperature is above 150 K, and/or a cold-hold step (b) during which the frigories supplied by the cooled working gas are used when the user temperature is below a cold setpoint, below 95 K, to keep the user temperature below said cold setpoint, said method being characterized in that, during the first phase (a1) of the cooling step (a) and/or, respectively, during the cold-hold step (b), the working gas is cooled by making said working gas circulate through a cold box which comprises in series at least a first brazed plate and fin aluminum heat exchanger, a second welded-plate heat exchanger and a third brazed plate and fin aluminum heat exchanger such that at least 1%, and preferably at least 4%, of the stream of said working gas from the compression station and entering the cold box is made to pass through the second exchanger then next at least 1% and preferably at least 4% of said stream of working gas is made to pass through the third exchanger before said stream of working gas is directed toward the user in order to supply the latter with frigories.

Advantageously, by interposing, downstream of the aluminum first exchanger and upstream of the likewise aluminum third exchanger, a welded-plate intermediate second exchanger, preferably made of stainless steel (or some other suitable alloy preferably not aluminum) capable of withstanding steep temperature gradients between the fluids exchanging heat through its offices, and by forcing at least part, if appropriate most, or even all, of the stream of working gas to pass through this second exchanger, the cold box, and notably the aluminum exchangers, are under all circumstances spared the thermomechanical stresses.

Specifically, because the second exchanger is able without damage to withstand steep temperature gradients, it can by itself perform a high-amplitude cooling of the working gas (the amplitude typically being greater than or equal to 100 K, 150 K or even 200 K) representing a significant share or even (largely) a majority share of the desired lowering of the temperature of the working gas.

By itself "absorbing" most of the temperature difference to be accommodated in order to suitably cool the working gas, the second exchanger thus leaves only a small residual amount of cooling (typically less than or equal to 50 K, or even less than or equal to 30 K), markedly less than that handled by said second exchanger, for the other exchangers (the first exchanger and especially the third exchanger), that perform better but are more fragile, to carry out.

The amount of residual cooling assigned to each of the first and third exchangers thus never exceeds the temperature gradient that the exchanger concerned can tolerate.

Because the second exchanger thus effectively protects the first and third exchangers against thermal "overloads", the longevity and performance of these exchangers are thereby improved.

This is why the method is quite particularly well suited to the cooling of a relatively "hot" user, the initial temperature of which exceeds 150 K at the time at which the cooling process according to the invention is implemented.

Furthermore, the presence of plate and fin aluminum exchangers tends to preserve the thermal performance of the method, notably when it is a matter of bringing the working gas down to a low temperature in the third exchanger (after the steep drop in temperature brought about by the second exchanger).

This performance proves to be particularly advantageous in the steady state, during the cold-hold step (b) when said method is carried out in order to maintain the status of a "cold" user (the user temperature of which is typically below 95 K and for example of the order of 80 K).

Furthermore, the fact of maintaining, in the steady cold-hold state, an at least partial or even total circulation of the stream of working gas through the (welded-plate) second exchanger in addition to the final circulation through the (brazed aluminum) third exchanger means that the second exchanger can handle part of the cooling, upstream of the third exchanger, which means that it is possible to use a third exchanger that is not as bulky as before.

Of course, the reduction in the size of the third exchanger that becomes possible through this use of the second exchanger contributes to improving the compactness of the cold box.

Ultimately, by making use of a careful selection and sequencing of heat exchangers and by proposing simplified management of the stream of working gas through said exchangers, all of which have the working gas passing successively through them, the method according to the invention proves to be particularly multifunctional because it allows effective management, using a particularly simple and compact cold box structure, of all the situations encountered in the life of the cryogenic installation, from the cooling of the user to the keeping of said user at a low temperature (and, if appropriate, to the heating of the user back up to ambient temperature at the end of the cooling cycle).

In practice, the method according to the invention therefore advantageously makes it possible to combine the advantages of aluminum exchangers in terms of thermal performance, notably at very low temperatures, and the thermomechanical robustness of the welded-plate intermediate exchanger.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The FIGURE represents a block flow diagram in accordance with an embodiment of the present invention.

DETAILED DESCRIPTION

Further objects, features and advantages of the invention will become apparent in greater detail from reading the following description and from studying the attached FIGURE, provided by way of purely nonlimiting illustration.

Said FIGURE is a schematic view of the implementation of a refrigeration method according to the invention.

The present invention relates to a refrigeration method during which a user 1 at a temperature referred to as the "user temperature" T1 is supplied with frigories by means of a working gas such as helium that is cooled in a refrigeration circuit 2.

The user 1 may be an industrial installation of any kind requiring a supply of frigories.

According to a preferred alternative form of embodiment, the method will be intended to supply cold to superconducting cables, for example within electromagnets intended to confine a plasma.

The method may if appropriate be a method for liquefying a gas and, in particular, a method for the liquefaction of nitrogen or of any other gas, for example helium.

The working gas may notably be pure helium or a gaseous mixture containing helium.

For preference, said working gas is circulated in a loop in a closed refrigeration circuit 2 that allows said working gas to be recycled, and thus continuously subjected to repeated compression/cooling and possibly expansion, cycles.

The invention of course also relates to a refrigeration circuit 2 and, more generally, to a cryogenic installation allowing implementation of such a method.

According to the invention, and as illustrated in the FIGURE, the refrigeration circuit 2 comprises at least one compression station 3, in which said working gas is compressed, then at least one cold box 4 in which the working gas is cooled by passing it through a plurality of heat exchangers 5, 15, 25, in this instance a first exchanger 5, a second exchanger 15 and a third exchanger 25.

According to one possible alternative form of embodiment, said cold box may also comprise at least one expansion turbine (not depicted) intended to cool the working gas by subjecting it to an adiabatic or near-adiabatic expansion.

As has been illustrated in the FIGURE, the refrigeration circuit 2 supplies the user 1 with frigories through a suitable heat exchange system 6 connected downstream of the third exchanger 25.

The working gas leaving the exchange system 6 having given up frigories to the user next returns to the compression station 3 following a return pipe 7.

According to an alternative form of embodiment, the cold box 4 may comprise two identical refrigeration circuits 2 operating in parallel, namely each receiving part of the stream of working gas coming from the compression station 3 and each cooling the share of the working gas that is assigned to them before, at the outlet of the cold box, directing said working gas toward the user 1.

According to the invention, the method comprises a cooling ("cool down") step (a) during which, during a cooling first phase (a1), the frigories supplied by the cooled working gas are used to lower the user temperature T1 when said user temperature T1 is above 150 K, and/or, alternatively or in addition to said cooling step (a) a cold-hold ("normal operation") step (b) during which the frigories supplied by the cooled working gas are used when the user temperature T1 is below a cold setpoint, less than 95 K, to keep the user temperature T1 below said cold setpoint.

According to the invention, during the first phase (a1) of the cooling step (a) and/or, respectively, during the cold-hold step (b), the working gas is cooled by making said working gas circulate through a cold box 4 which comprises in series at least a brazed plate and fin aluminum first heat exchanger 5, a welded-plate second heat exchanger 15, and a brazed plate and fin aluminum third heat exchanger 25 so that at least 1%, and preferably at least 4%, of the stream of said working gas coming from the compression station 3 and entering the cold box (4) is made to pass through the second exchanger 15 then next at least 1% and preferably at least 4% of said stream of working gas is made to pass through the third exchanger 25 before said stream of working gas and, more particularly, all of the stream of gas that has passed through the cold box 4, is directed toward the user 1 to supply the latter with frigories.

In practice, the minimum quantity of working gas passing through the second exchanger 15 and or the third exchanger 25 may notably be comprised between 4% and 5% and for example of the order of 4.8%.

For the convenience of description it will be considered that the stream of working gas and the proportions of said stream of gas, expressed in percentages, correspond to the mass flow rate of the working gas (refrigerant) and, respectively, to percentages of said mass flow rate.

By ensuring, on each working cycle, that at least a (non zero) fraction, or even the majority, of the working gas systematically passes on the one hand through the welded-plate second exchanger 15 that is particularly resistant to steep temperature gradients and, on the other hand, through the plate and fin aluminum third exchanger 25, which performs particularly well thermally at low temperature, it is possible to manage the refrigeration effectively both during transient states, notably during the first phase (a1) of cooling a "warm" or "hot" user (the temperature T1 of which initially exceeds 150 K), the second exchanger 15 then bearing the brunt of the thermal shock, and during the steady cold-hold state during which the third exchanger 25 then takes a predominant role.

Moreover, the working gas circulation diagram is preferably such that, during cooling step (a) and, more particularly, the first phase (a1) thereof, or during cold-hold step (b), and preferably throughout all of these steps, most, which means to say more than 50%, preferably more than 75%, more than 80% or even more than 90%, or even, for preference, all, namely 100%, of the working gas that enters the cold box 4 and, where appropriate, more generally of the working gas leaving the compression station 3 at "high pressure" (in practice at around 18 bar) is directed toward the first exchanger 5 so that this majority, or even all, of the stream of said working gas that enters the cold box 4 does effectively pass through said first exchanger 5 where it can be cooled.

Thus, and according to what could constitute a separate invention of its own, notably during the cold-hold step (b), the majority and preferably all of the stream of working gas that enters the cold box 4 is preferably made to pass first of all through the first exchanger 5 before all or part of said stream of working gas is made to pass through the second exchanger 15 then all or part of said stream of working gas is passed through the third exchanger 25.

Advantageously, the fact of using the three exchangers 5, 15, 25 present within the cold box simultaneously, at least at part of their handling capacity, and doing so whether in a cooling situation or a cold-hold situation, means that the overall efficiency of the cold box 4 can be improved while at the same time limiting the individual size of each exchanger 5, 15, 25 and therefore the overall size of said cold box 4.

In this respect, it will notably be noted that the in-series combination of the second exchanger 15 and of the third exchanger 25 during (at least) the cold-hold step (b) advantageously makes it possible to optimize the cooling to a very low temperature by splitting said cooling successively between said second and third exchangers 15, 25, something which makes it possible to avoid having to oversize said exchangers 15, 25.

According to a preferred alternative form of embodiment which may concern both cooling step (a) (and notably the first phase (a1) thereof) and the cold-hold step (b), all of the stream of working gas that passes through the second exchanger 15 next also passes through the third exchanger 25.

The second and third exchangers 15, 25 can advantageously thus be combined in cascade thereby improving the performance of the cold box without detracting from its compactness, and doing so using for this purpose a simple tube directly connecting said exchangers 15, 25 thereby reducing the cost of the cold box 4 and limiting pressure drops.

For preference, cooling step (a) and more particularly the cooling first phase (a1) is carried out when the initial user temperature T1 is greater than or equal to 200 K, 250 K, 300 K or even 350 K.

For preference, the method and more particularly the first phase (a1) of cooling step (a) will be carried out to supply one (or more) users the temperature T1 of which will not exceed 450 K and preferably 400 K.

More generally, the first phase (a1) of cooling step (a) may be carried out while, or even for as long as, the user temperature T1 is comprised between (strictly) 150 K and 400 K and, more particularly, between (strictly) 150 K and 350 K, for example between 250 K and 350 K or even between 250 K and 300 K.

Advantageously the permanent circulation of working gas through the second exchanger 15 in fact guarantees at all times protection of the cold box 4 against the effects of large temperature differences, thereby making the method extremely multifunctional, as it can thus directly cope as easily with "cold" users (the temperature T1 of which is below 95 K and notably comprised between 70 K and (strictly) 95 K) as it can "hot" users (typically at a temperature T1 (strictly) above 150 K and notably at an ambient temperature T1 of around 300 K) or even "extremely hot" users (the temperature T1 of which may for example reach 350 K or even 400 K).

According to an alternative form of embodiment of the method, and in particular during the cold-hold step (b), the majority or even all of the stream of working gas that enters the cold box 4 and that preferably passes through the first exchanger 5 next passes through the second exchanger 15, situated downstream of the first exchanger 5, so that there it (for a second time) gives up heat and thus continues its cooling.

Likewise, according to this alternative form of embodiment, most, if not all, of the stream of working gas next passes through the third exchanger 25, situated downstream of the second exchanger 15, so that there it (for a third time) gives up heat and thus continues to cool.

In absolute terms, it is not out of the question for one or more tapping valves to be provided within the cold box 4 so as to allow part of the working gas to be directed in isolated instances out of the cooling circuit 2 or even one or more "bypass" lengths that allow one or other of the first, second or third exchangers 5, 15, 25 to be bypassed (short-circuited) so as to divert a proportion, preferably a minority proportion (which means to say preferably strictly less than 50%, than 25%, than 20% or even than 10%) of the stream of working gas so that this fraction does not pass through the exchanger concerned (although it does remain within the closed circuit).

However, for preference, during the cold-hold step (b), the stream of working gas that will pass through the first exchanger 5 will next be collected in its entirety as it leaves said first exchanger 5 and conveyed in its entirety through the second exchanger 15.

Likewise, and preferably in combination with the aforementioned link between the first and second exchanger, the stream of working gas coming from the second exchanger 15 will preferably be collected in its entirety as it leaves said second exchanger 15 and conveyed in its entirety through the third exchanger 25, during this same cold-hold step (b).

As a particular preference, according to a particularly simplified layout of cold box 4, and preferably during the steady cold-hold state, all of the stream of working gas coming from the compression station 3 may be sent to the first exchanger 5, then to the second exchanger 15, then to the third exchanger 25, so that the entirety of the stream of working gas will pass in succession through the first exchanger 5, then the second exchanger 15, then the third exchanger 25 during one and the same working cycle (namely during one and the same "circuit" of refrigeration circuit 2), before supplying the user 1, then returning to the compression station 3.

For preference, cooling step (a) continues, after the cooling first phase (a1) with a cooling second phase (a2) during which the cooling begun during the cooling first phase (a1) is extended until the user temperature (T1) reaches the cold setpoint.

Once the cold setpoint has been reached, the cold-hold step (b) is then preferably engaged, while at the same time keeping the working gas circulating through the second exchanger 15.

As stated above, at least partial use of the second exchanger 15 is maintained both during cooling, in order to ensure the thermal safety of the exchangers 5, 15 and notably of the third exchanger 25, and during the cold-hold, in order to optimize the performance, for a given size, of the cold box 4.

According to one alternative form of embodiment, it is conceivable, when making the transition from cooling step (a) to cold-hold step (b) to keep a distribution configuration of the stream of working gas through the first, second and third exchangers 5, 15, 25 that is substantially the same as the distribution configuration used during cooling step (a).

In other words, according to a preferred feature which may constitute an invention all of its own, it is potentially possible to maintain the same series connection configuration of the first, second and third exchangers, and therefore the same configuration whereby the working gas passes successively through said first, second and third exchangers 5, 15, 25 both during the transient cooling state and during the steady cold-hold state, namely both "when hot" and "when cold".

More particularly, according to this alternative form and regardless of the operating regime, it is possible to maintain a substantially identical distribution of the working gas through the various successive exchangers 5, 15, 25.

Advantageously, the hardware connections between the first, second and third exchangers 5, 15, 25 within the cold box 4, and therefore the path of the refrigeration circuit 2 followed by the working gas, may then remain unchanged under all circumstances, whatever the operating regime of said cold box 4.

In particular, according to this alternative form, it will be possible to dispense with the need to make switchings, according to the operating regime of the cold box 4, between several legs of the refrigeration circuit 2 aimed at selectively connecting or, on the other hand, at bypassing, one or other of the exchangers 5, 15, 25.

This permanency makes it possible to simplify the arrangement and management of said cold box 4 and thus reduce not only its size but also its cost and cost of operation while at the same time improving its reliability and longevity.

However, according to another alternative form of embodiment of the method, during cooling step (a) and more particularly during the first cooling phase (a1), the stream of working gas is distributed upstream of the second exchanger 15 between a first leg 8 referred to as the "cooling leg", depicted in solid line in the FIGURE, which passes in succession through the second exchanger 15 and the third exchanger 25, and a second leg 9, referred to as the "bypass leg", depicted in dotted line in the FIGURE, which bypasses the second exchanger 15 and the third exchanger 25 to then join up with the stream of working gas coming from said third exchanger 25.

Advantageously, the bypass leg 9 makes it possible to bypass the entire cooling leg 8, by carrying part of the working gas directly from a tapping point provided with a flow splitter 10 and situated downstream of the first exchanger 5 and upstream of the second exchanger 15, to a junction point 11 situated downstream of the third exchanger 25 and upstream of the user 1 (notably without cutting into the cooling leg 8 between the second and third exchangers 15, 25).

Advantageously, by splitting the stream of working gas coming from the first exchanger 5 between the first and second legs 8, 9, less demand is placed on the second exchanger 15 and especially the third exchanger 25 during cooling step (a), and thus notably makes it possible to limit the thermal stresses and pressure drops.

For preference, during the transition from cooling step (a) to cold-hold step (b) and according to a feature which may constitute a separate invention of its own, the circulation of the working gas through the second leg 9, referred to as the "bypass" leg is reduced and preferably blocked so as to force the majority, and preferably all, of the stream of working gas entering the cold box 4 to pass in succession, during cold-hold step (b) through the second exchanger 15 then the third exchanger 25 by following the first leg 8 referred to as the "cooling" leg.

It is thus possible to benefit from simultaneous operation of all three exchangers 5, 15, 25 and therefore from increased performance, using a circuit that is very simple.

Whatever, the rest of the envisioned alternative (unvarying configuration or, on the other hand, selective switching of the bypass leg 9), the simplification of the cold box 4 will make it possible to reduce pressure drops, and potential sources of breakdowns or leaks, whereas the permanent connection (and where appropriate predominant connection) of the second exchanger 15 to the cooling circuit 2 will afford protection against the effects of a (deliberate or even accidental) connection to a "hot" user.

Where appropriate, adapting the refrigeration circuit 2 to the regime of operation considered at a given moment will be able to be performed by simply adjusting the flow rate of the working gas and/or the flow rate of the auxiliary cold fluids through the first, second and third exchangers 5, 15, 25.

The first exchanger 5 and the third exchanger 25 are advantageously of the brazed plate and fin aluminum exchanger ("aluminum plate-fin heat exchanger") type and in that respect may meet the ALPEMA ("Aluminium Plate-Fin Heat Exchanger Manufacturer's Association") recommendations.

Such aluminum exchangers are indeed both particularly compact and perform well from a thermal standpoint.

For preference, by way of second exchanger 15, use is made of a welded-plate exchanger made of stainless steel or, where appropriate, a suitable stainless metal alloy, other than aluminum (which is too fragile).

Such an exchanger, the technology of which is also known by the term "plate and shell", and which of course has a number of plates (typically more than three plates) and an exchange surface area suited to the application, is in fact extremely robust, and notably exhibits excellent mechanical resistance to steep thermal gradients.

As a particular preference, by way of second exchanger 15, use is made of a printed circuit heat exchanger (PCHE).

Such an exchanger, which is formed by assembling (for example by furnace brazing) a plurality of stacked plates in which grooves, that form the flow channels, have previously been hollowed through a chemical (etching) route, is indeed advantageously particularly compact.

According to a preferred alternative form of embodiment, the second exchanger 15 may form a countercurrent exchanger as illustrated in the FIGURE, within which the working gas, in this instance helium (He), flows countercurrentwise with respect to a cold fluid in order to give up heat to the latter, which then removes it using a suitable device.

Because the second exchanger 15 is well able to withstand steep thermal gradients, it is in fact possible within the second exchanger 15 to cool effectively a working gas that is relatively hot (for example that may reach 270 K or even 300 K at the inlet to the exchanger 15) using a particularly cold auxiliary fluid (such as liquid nitrogen, which has an inlet temperature of the order of 80.8 K) circulating countercurrentwise with respect to said working gas.

In any event, it is preferable within the second exchanger 15 to use a cold auxiliary fluid, such as liquid nitrogen (LIN), preferably circulating countercurrentwise, in order to cool the working gas.

In this particular instance, as illustrated in the FIGURE, the second exchanger 15 may thus form a printed circuit heat exchanger of the helium-liquid nitrogen (HE-LIN PCHE) type, within which liquid nitrogen (LIN), circulating countercurrentwise with respect to the working gas (He) and typically having an inlet temperature of the order of 80.8 K, vaporizes to gaseous nitrogen (N2) in order to remove heat energy from said working gas (He).

Moreover, according to a preferred alternative form of embodiment, use is made, by way of first exchanger 5, of a gas/gas exchanger, preferably a countercurrent exchanger, in which the working gas returning from the user 1 receives, before arriving at the inlet to the compression station 3, heat given up by the compressed working gas coming from said compression station 3.

In particular, as illustrated in the FIGURE, the return pipe 7 may thus pass through the first exchanger 5, which is an exchanger of the brazed aluminum helium-helium exchanger type (BAHX He—He, which stands for "brazed aluminum heat exchanger He—He") so that the "cold" helium (typically at around 100 K) at "low" pressure (typically 16 bar) which returns toward the compression station 3 can warm up (typically warm to ambient temperature, namely between 290 K and around 307 K) by circulating countercurrentwise with respect to the compressed (typically at around 18 bar) and "hot" (typically at around 300 K to 310 K) helium leaving the compression station 3 to go down toward the user 1.

For preference, by way of third exchanger 25, use is made of a liquid nitrogen thermosiphon, preferably a cocurrent thermosiphon.

In particular, as has been illustrated in the FIGURE, it may thus be possible to make the auxiliary fluid that the liquid nitrogen (LIN) constitutes circulate cocurrently with respect to the stream of helium (working gas) coming down toward the user 1.

The nitrogen, which typically passes from 79.8 K to 80.8 K in said third exchanger 25, and which passes from liquid state (LIN) to gaseous state (GAN, which stands for gaseous nitrogen), picks up the heat from the stream of helium and thus lowers the temperature thereof to around 80 K.

By way of indication, at the start of the cooling first phase (a1), in the transient state, the user temperature T1 may be of the order of 300 K (ambient temperature).

The temperature of the working gas progressing back toward the compression station 3 and entering the first exchanger as cold fluid is therefore of the order of 300 K.

The returning gas picks up heat as it passes through the first exchanger 1 and may thus find itself at around 307 K, and at a low pressure of the order of 16 bar as it enters the compression station 3.

After compression, the gas at high pressure, approximately 18 bar, has a temperature of 310 K when it reaches the first exchanger 5.

On leaving said first exchanger 5 its temperature has been lowered to around 302 K.

The portion of this stream of gas at 302 K that follows the cooling leg 8 is greatly cooled in the second exchanger 15, which lowers its temperature to around 95 K, and therefore handles most of the cooling of said cooling leg 8.

It will be noted that the second exchanger 15, which handles most of the cooling, is perfectly able to tolerate countercurrent circulation on the one hand of the helium (working gas) which passes from 302 K to 95 K and, on the other hand, of the liquid nitrogen (auxiliary fluid) which has a very low temperature, of the order of 80 K, and which passes from the liquid state into a gaseous or diphasic liquid/gas state.

On passing through the third exchanger 25, this same stream of working gas has its temperature lowered to around 80 K.

This stream at 80 K which leaves the third exchanger 25 then mixes, at a junction point labeled 11 in the FIGURE with the stream at 302 K coming from the bypass leg 9, then all of the working gas will next feed into the exchange system 6 of the user 1.

In the steady state, namely during the cold-hold step (b) and, more preferably, when the working gas is circulating exclusively through the cooling leg 8, the working gas typically has a temperature of the order of 103 K as it enters the second exchanger 15, and of 95 K approximately as it leaves said second exchanger 15, which is therefore under far less demand than it was in the transient state.

On leaving the third exchanger 25, the working gas which reaches the user may advantageously have a very low temperature, of the order of 80.4 K.

It will moreover be noted that, in the example described in the foregoing, and as envisioned earlier on in general, the first (BAHX He—He) exchanger 5 has all of the stream of working gas (in this instance helium) that enters the cold box 4 passing through it, this moreover being both when in the transient cooling state and when in the steady cold-hold state.

In this instance, all of the stream of working gas passes through said first exchanger 5 a first time, as hot fluid that needs to be cooled, entering the cold box 4 to be cooled there, and then a second time, as cold fluid, returning from the user 1, before leaving said cold box 4 again.

Of course the invention also relates to a refrigeration device as such, intended to implement a refrigeration method according to one or other of the aforementioned features.

It relates more particularly to a cold box 4 allowing implementation of said method and more particularly designed to ensure circulation of the working gas according to the invention.

The invention thus relates more particularly to a cold box 4 intended for cooling a working gas, said cold box comprising, in series, within the same insulated enclosure, at least a brazed plate and fin aluminum first heat exchanger 5, a welded-plate stainless steel second heat exchanger 15, and a brazed plate and fin aluminum third heat exchanger 25.

According to a preferred alternative form of embodiment, said cold box comprises at least a first leg 8 for the circulation of working gas, referred to as the "cooling leg" 8, which passes in succession through the second exchanger 15 and the third exchanger 25, and a second leg 9 for the circulation of working gas, referred to as the "bypass leg" 9, which bypasses the second exchanger 15 and the third exchanger 25 to meet up, preferably directly, with the outlet of the third exchanger, and a flow splitter 10 designed to selectively direct the stream of working gas coming from the first exchanger 5 exclusively into the first leg 8 referred to as the "cooling" leg or alternatively to distribute said stream of working gas partly into the first leg 8 referred to as the "cooling" leg and partly into the second leg 9 referred to as the "bypass" leg.

The flow splitter 10 may for example take the form of a multi-way valve or alternatively of a manifold, provided with an inlet, connected to the outlet of the first exchanger 5, and with at least two outlets, one connected to the first leg 8 and the other to the second leg 9, at least one of said outlets, and preferably each of said outlets, being provided with at least one valve which, where appropriate, allows the flow rate of working gas in the corresponding leg 8, 9 to be regulated.

Advantageously, the bypass leg 9 will not communicate with the tube that connects the outlet of the second exchanger 15 to the inlet of the third exchanger 25, such that all of the working gas bled off upstream of the second exchanger 15 by said bypass leg 9 will be conveyed directly thereby to a junction point 11 situated downstream of the third exchanger 25 and upstream of the user 1, which junction point 11 is where said gas will be mixed with the stream of gas coming from said third exchanger 25.

Such an alternative form of cold box 4 will advantageously allow a simple and rapid switchover between a preferred transient state (notably cooling state) configuration in which the bypass leg 9 is active, so that the stream of gas passing through the cold box 4 and coming from the first exchanger 5 is distributed between the cooling leg 8 (to an extent of at least 1% and preferably at least 4%) on the one hand, and the bypass leg 9 on the other, and a preferred steady-state (cold-hold) configuration in which the flow splitter 10 reduces, or even closes off, access to the bypass leg 9 so that a proportion of the stream of working gas that is a larger proportion than the proportion during the transient state, and preferably most if not all of said stream of working gas, passes through the second exchanger 15 then the third exchanger 25.

According to another possible alternative form of embodiment of the cold box 4 which is particularly simplified and compact, said exchangers 5, 15, 25 may be connected in series to one another in that order so as to form a linear cooling circuit (the path of which corresponds typically to the cooling leg 8 mentioned in the foregoing), intended for the passage of the working gas, said circuit being materially devoid of connections or bypass legs that could allow the working gas to bypass one or other of said exchangers 5, 15, 25, such that all of the stream of working gas that passes through the first exchanger 5 next has to pass in turn through the second exchanger 15 then the third exchanger 25, following said cooling circuit.

It is thus possible to cause all of the stream of working gas coming from the compression station 3 to circulate, preferably permanently, whatever the operating regime, in turn through the first exchanger, then next through the second exchanger, then finally through the third exchanger, with all the advantages mentioned above.

Furthermore, the use of a linear cooling circuit that directly connects the outlet of the exchanger 5, respectively 15, considered to the inlet of the exchanger 15, respectively 25, situated immediately downstream, by means of a tube with no connections or excessive bent portions, makes it possible to create a cold box 4 that is compact, simple and inexpensive and amongst other things minimizes pressure drops.

For preference, and incidentally whatever its alternative form of internal arrangement, the cold box 4 is thermally insulated from its environment using perlite.

This then effectively avoids losses of frigories.

The invention moreover relates to a cryogenic installation as such, that allows implementation of a refrigeration method according to the invention.

Said installation may to this end comprise a module that regulates and configures the cold box 4, said module controlling the circuit of exchangers 5, 15, 25 of said cold box so as to always leave access to the second exchanger 15 and to the third exchanger 25 so as always to direct at least 1%, preferably at least 4%, of the stream of working gas entering the cold box 4 through the second exchanger 15 and through the third exchanger 25.

The invention relates in particular to a cryogenic installation comprising a looped refrigeration circuit 2 for a working gas, said refrigeration circuit 2 comprising in series at least one compression station 3 intended to compress said working gas, then at least one cold box 4 according to one or other of the abovementioned alternative forms, said cold box 4 being intended to cool the working gas by passing it through a plurality of heat exchangers 5, 15, 25, then a heat exchange system designed to allow the cooled working gas coming from the cold box 4 to give up frigories a user 1.

Of course, the invention is not in any way restricted merely to the alternative forms of embodiment described, the person skilled in the art notably being capable of isolating or combining freely with one another one or other of the aforementioned features or substituting equivalents therefor.

In particular, the considerations associated with the transient cooling state (and with handling the corresponding temperature gradients) may be applied mutatis mutandis to the warming-up of the user, namely to the progressive return of the user from a cold state to a hot state at the end of the cooling cycle.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A refrigeration method during which a user at a user temperature is cooled by a working gas comprising helium, wherein the working gas is cooled in a refrigeration circuit which comprises at least one compression station that compresses said working gas, there being at least one cold box containing a first heat exchanger, a second heat exchanger, and a third heat exchanger, wherein the first heat exchanger comprises a brazed plate and fin aluminum heat exchanger, wherein the second heat exchanger comprises a weld-plate heat exchanger, and wherein the third heat exchanger comprises a second brazed plate and fin aluminum heat exchanger, said method comprising:

(a) a first mode of operation comprising lowering the user temperature during a first transient cooling phase using cooling supplied by a cooled working gas when said user temperature is above 150 K, wherein the first transient cooling phase comprises the steps of:

compressing the working gas in the at least one compression station and then cooling the working gas in the first heat exchanger;

cooling at least a portion of the working gas in the second heat exchanger to a first cold temperature and then further cooling the at least portion of the working gas in the third heat exchanger;

combining any remaining portion of the working gas with the at least portion of the working gas at a location that is downstream the third heat exchanger and upstream the user to form a cooled working gas, wherein the remaining portion of the working gas is at an exit temperature of the first heat exchanger when being combined with the at least portion of the working gas downstream;

providing cooling energy to the user by exchanging heat with the cooled working gas to thereby lower the user temperature; and returning the working gas to the at least one compression station, wherein the at least portion of the working gas cooled in the second heat exchanger and third heat exchanger comprises at least 1% of the working gas compressed in the at least one compression station and cooled in the first heat exchanger; and (b) a second mode of operation comprising maintaining the user temperature below a cold set-point, wherein the cold set-point is below 95 K, wherein the second mode of operation further comprises the steps of:

compressing the working gas in the at least one compression station and then cooling the working gas in the first heat exchanger;

cooling the working gas in the second heat exchanger to a cold temperature and then further cooling the working gas in the third heat exchanger;

providing cooling energy to the user by using the working gas to thereby maintain the user temperature below the cold set-point; and returning the working gas to the at least one compression station.

2. The method as claimed in claim 1, wherein during the first mode of operation, all of the at least portion of the working gas that is cooled in the second heat exchanger is also cooled in the third heat exchanger.

3. The method as claimed in claim 1, wherein during the first mode of operation, an initial user temperature is greater than or equal to a temperature selected from the group consisting of 200 K, 250 K, 300 K and 350 K.

4. The method as claimed in claim 1, wherein the first mode of operation further comprises a second transient cooling phase having the steps of: lowering the user temperature from 150 K to the cold set-point using cooling supplied by the cooled working gas; and then switching to the second mode of operation once the user temperature reaches the cold set-point.

5. The method as claimed in claim 4, wherein upon transition from the first transient cooling phase to the second transient cooling phase to the second mode of operation, a volumetric flow of the remaining working gas which bypasses the second and third heat exchangers is reduced in order to force a majority of the working gas that is cooled in the first heat exchanger to pass in succession to the second and third heat exchangers for cooling therein.

6. The method as claimed in claim 4, wherein upon transition from the first transient cooling phase to the second transient cooling phase to the second mode of operation, a volumetric flow of the remaining working gas which bypasses the second and third heat exchangers is completely stopped such that all of the working gas that is cooled in the first heat exchanger to pass in succession to the second and third heat exchangers for cooling therein.

7. The method as claimed in claim 1, wherein the second heat exchanger comprises a stainless steel welded-plate exchanger.

8. The method as claimed in claim 1, wherein the second heat exchanger comprises a printed circuit exchanger (PCHE).

9. The method as claimed in claim 1, wherein the first exchanger comprises a gas/gas exchanger in which the working gas returning from the user before reaching the inlet of the at least one compression station receives heat given up by the working gas coming from said compression station.

10. The method as claimed in claim 1, wherein the third heat exchanger comprises a liquid nitrogen (LIN) thermosiphon.

11. The method as claimed in claim 1, wherein an auxiliary cold fluid is used within the second heat exchanger exchanger in order to cool the at least portion of the working gas during the first mode of operation and the working gas during the second mode of operation.

12. The method as claimed in claim 1, wherein the first heat exchanger comprises a gas/gas heat exchanger, and wherein vaporization occurs in both the second and third heat exchangers.

13. An insulated cold box for cooling a working gas, said cold box comprising within the insulated cold box:

a first heat exchanger comprising a brazed plate and fin aluminum heat exchanger;

a flow splitter having an inlet in fluid communication with a cold outlet of the first heat exchanger;

a second heat exchanger comprising a weld-plate heat exchanger, wherein the second heat exchanger is in fluid communication with a first outlet of the flow splitter;

a third heat exchanger comprising a second brazed plate and fin aluminum heat exchanger, wherein the third heat exchanger is in fluid communication with the second heat exchanger;

a fourth heat exchanger configured to warm the working gas;

a mixer in fluid communication with a second outlet of the flow splitter and the third heat exchanger, such that the mixer is configured to receive fluids from the flow splitter and the third heat exchanger;

a cooling leg configured to circulate a first portion of the working gas in succession from the first heat exchanger through the second heat exchanger and the third heat exchanger and into the mixer; and a bypass leg configured to circulate a second portion of the working gas from the flow splitter to the mixer without flowing through the second heat exchanger or the third heat exchanger, wherein the flow splitter is configured to selectively direct the working gas coming from the first exchanger exclusively into the cooling leg or alternatively to distribute said working gas partly into the cooling leg and partly into the bypass leg.

14. The cold box as claimed in claim 13, wherein the insulated cold box is thermally insulated using perlite.

15. The cold box as claimed in claim 13, wherein the flow splitter is configured to control the flow rates of the working gas within the bypass leg and the cooling leg based on a temperature measured of the working gas after being warmed in the fourth heat exchanger.

* * * * *